US007018132B2

(12) United States Patent
Ewer et al.

(10) Patent No.: US 7,018,132 B2
(45) Date of Patent: Mar. 28, 2006

(54) ROTATING CONCRETE FINISHING TROWEL

(76) Inventors: Charles J. Ewer, 27113 State Hwy. 27, Holcomb, WI (US) 54745; William T. Niznik, 1263 West St., Lublin, WI (US) 54447

( * ) Notice: Subject to any disclaimer, the term of this patent is extended or adjusted under 35 U.S.C. 154(b) by 0 days.

(21) Appl. No.: 10/846,398

(22) Filed: May 17, 2004

(65) Prior Publication Data

US 2005/0254896 A1 Nov. 17, 2005

(51) Int. Cl.
*E01C 19/22* (2006.01)

(52) U.S. Cl. ..... 404/112

(58) Field of Classification Search ..... 404/112, 404/118

See application file for complete search history.

(56) References Cited

U.S. PATENT DOCUMENTS

| | | | | | |
|---|---|---|---|---|---|
| 2,289,248 | A | * | 7/1942 | Davis | 264/31 |
| 2,342,445 | A | | 2/1944 | Allen | 94/45 |
| 2,556,983 | A | | 6/1951 | Root | 94/45 |
| 2,605,683 | A | | 8/1952 | Boulton | 94/45 |
| 2,621,568 | A | | 12/1952 | Fletcher | 94/45 |
| 2,667,824 | A | | 2/1954 | McCrery | 94/45 |
| 2,689,507 | A | | 9/1954 | McCrery | 94/45 |
| 2,759,305 | A | | 8/1956 | Helbig | 51/170 |
| 2,836,056 | A | | 5/1958 | Drummond | 72/136 |
| 3,781,991 | A | * | 1/1974 | Stretton et al. | 30/276 |
| 4,232,980 | A | * | 11/1980 | Tertinek et al. | 404/112 |
| 4,641,995 | A | * | 2/1987 | Owens | 404/118 |
| 5,096,330 | A | * | 3/1992 | Artzberger | 404/97 |
| 5,147,146 | A | * | 9/1992 | Harding, Jr. | 404/97 |
| 5,221,156 | A | * | 6/1993 | Martin | 404/97 |
| 5,375,942 | A | | 12/1994 | Lindley | 404/97 |
| 5,857,803 | A | * | 1/1999 | Davis et al. | 404/102 |
| 5,984,571 | A | * | 11/1999 | Owens | 404/97 |
| 6,019,545 | A | * | 2/2000 | Allen et al. | 404/112 |
| 6,200,065 | B1 | * | 3/2001 | Eitzen | 404/114 |
| 6,516,598 | B1 | * | 2/2003 | Notaras et al. | 56/16.7 |
| D472,248 | S | | 3/2003 | Riess et al. | 15/3 |
| 6,637,974 | B1 | | 10/2003 | Glenn | 404/112 |

* cited by examiner

*Primary Examiner*—Gary S. Hartmann
(74) *Attorney, Agent, or Firm*—James V. Harmon

(57) ABSTRACT

A rotary cement or concrete finishing trowel has an operating head at one end of the apparatus that includes at least one cement finishing blade rotatably mounted for movement in a horizontal plane for smoothing a concrete floor surface. A drive motor, e.g., a 2-cycle gas engine, is provided at the other end of the apparatus. An elongated frame element is connected between the motor framework and the operating head and is preferably rigidly connected between them. A drive shaft extends diagonally between the motor and the operating head for imparting rotation to the finishing blade. The elongated frame element can be a tubular housing that surrounds the drive shaft and is rigidly connected at one end to the motor framework and at the other end is rigidly connected to the operating head so that the operator is able to use the frame element as a handle for lifting the entire apparatus over obstructions during operation as the weight of the motor at least partially counterbalances the weight of the operating head.

18 Claims, 7 Drawing Sheets

ROTATING CONCRETE FINISHING TROWEL

FIELD OF THE INVENTION

This invention relates to concrete finishing and more particularly to a motor-driven rotating finishing trowel for concrete.

BACKGROUND OF THE INVENTION

Rotating concrete finishing machines currently in use are relatively heavy, often weighing over 65 pounds, are usually difficult to maneuver and are expensive to produce. Because of their bulk and weight distribution, prior devices are awkward to handle and virtually impossible to lift while in operation any more than it would be possible to lift a wheelbarrow by its handles. This makes it hard to clear objects or to place the machine in restricted spaces such as in closets, under stairways or behind pipes. In addition, because of the way they are constructed, it is difficult or impossible to finish the concrete all the way to each wall of a room. Instead, it is considered normal for current equipment to leave a 3" or 4" gap of unfinished concrete next to the wall so that the cement worker must put on kneeboards so that he can hand trowel the unfinished area next to the wall around the entire room. In U.S. Pat. No. 2,342,445, which is typical, the troweling blades are spaced centrally 2" or so from the ring guard 34 as shown in FIG. 2 and in U.S. Pat. No. 2,605,683 the blade 19 is spaced centrally from the guard ring 3 (FIG. 2). Likewise in U.S. Pat. No. D 472,248 the blades are shown spaced centrally from the guard in FIG. 4 and U.S. Pat. No. 6,637,974 provides wall roller guards that keep the blades away from the wall.

In view of these and other deficiencies of the prior art, it is one object of the invention to find a way of building a concrete finishing machine so that while in operation it can clear obstructions such as pipes or door sills and easily get over other objects that are connected to the floor as well as around them while the machine is in operation.

Another more specific object of the invention is to provide a concrete finishing machine that will finish concrete all the way to each wall of a room and can be easily maneuvered around pipes and into small spaces and corners.

Another object of the invention is to provide a concrete finishing machine that will provide a total floor finish without the requirement for hand finishing next to walls and in corners.

Another object of the invention is to provide an improved concrete finishing machine that is smaller and lighter than prior equipment and is able by making possible an operating head with a low profile to get under objects such as stairways, readily maneuvered around pipes, easily lifted manually over objects that project upwardly from the floor and placed in restricted areas such as closets.

A further specific object of the invention is to provide a rotating concrete finishing machine that is balanced in a way that enables it to be easily lifted by hand, is rugged in construction, reliable in operation, can be produced at low cost and has a motive power unit that can be supported by the operator during use.

These and other more detailed and specific objects of the present invention will be better understood by reference to the following figures and detailed description which illustrate by way of example but a few of the various forms of the invention within the scope of the appended claims.

THE FIGURES

SUMMARY OF THE INVENTION

The invention is used for finishing concrete in various forms, sometimes referred to by the misnomer "cement" which is a component of concrete. The invention provides a power operated rotating concrete finishing trowel having an operating head at one end of the apparatus that includes at least one concrete finishing blade rotatably mounted thereon. A drive motor, e.g., a 2-cycle gas engine, is provided at the other end of the apparatus. An elongated frame element is connected between the motor and the operating head. A drive shaft extends between the motor and the operating head for imparting rotation to the finishing blade. In a preferred form of the invention, the elongated frame element is a tubular housing that surrounds the drive shaft and is rigidly connected at one end to the motor framework and at the other end is rigidly connected to the operating head so that a center portion of the frame element can be used as a handle for lifting the machine over obstructions as the weight of the motor at least partially counterbalances the weight of the operating head. The term "concrete" herein is used broadly to include various compositions that employ portland cement or simply cement as a binding matrix.

DETAILED DESCRIPTION OF THE INVENTION

Figure 1:
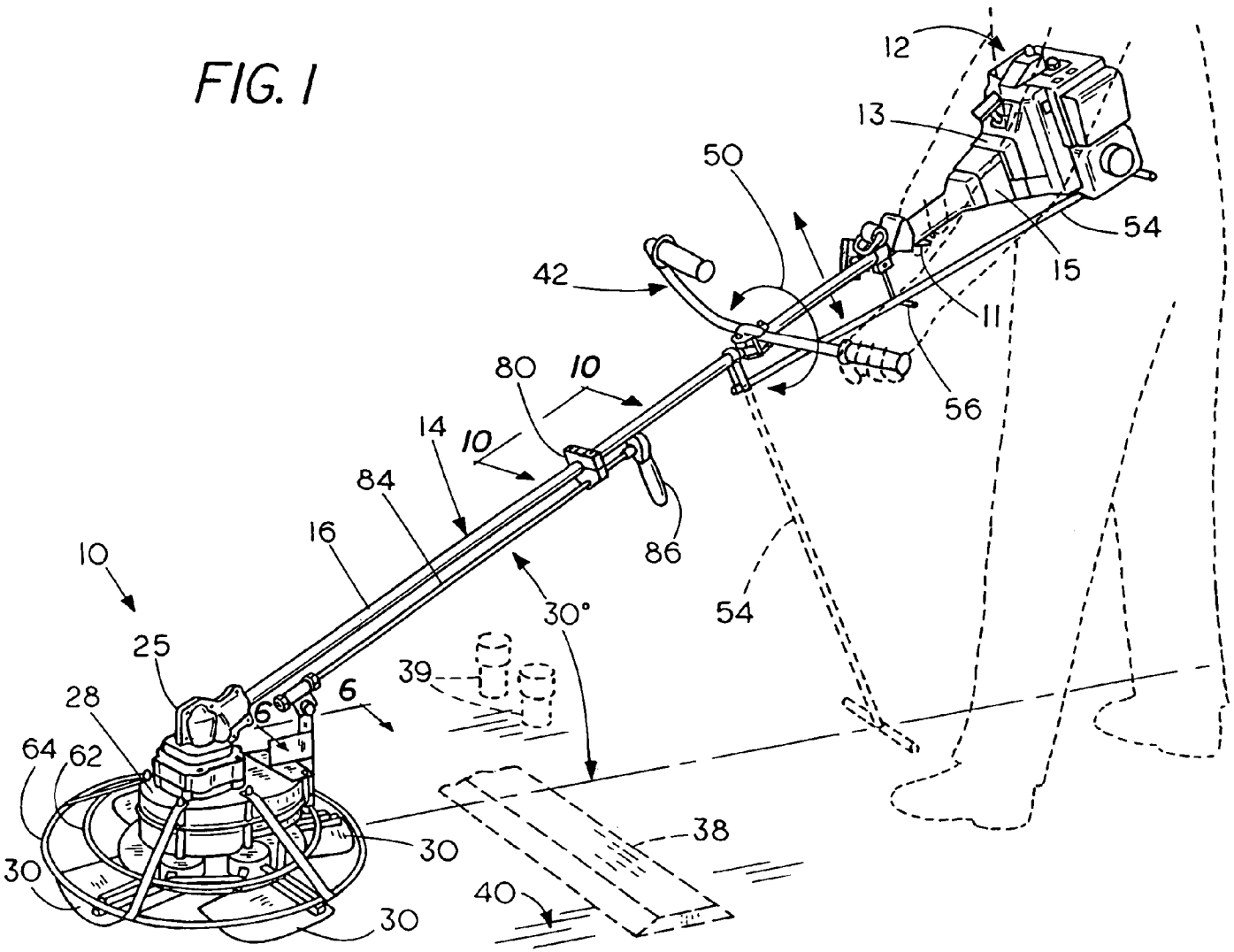
FIG. 1 is a perspective view of the invention during use.

As shown in FIG. 1, the invention provides a rotating concrete finishing trowel for surfacing concrete or "cement" that includes an operating head 10 at one end, a drive motor 12 at the opposite end and an elongated connecting frame element 14 rigidly connected between the framework 15 of the motor 12 and the operating head 10. In a preferred embodiment, the motor 12 is typically a 1.5 horsepower, 2 cycle 25 cc gas engine of suitable known commercially available construction having a self-contained centrifugal clutch 13 or if desired an electric motor using either batteries or standard electrical power. The connecting element in the embodiment shown preferably comprises a tubular housing 16 (FIG. 3) preferably about 4 or 5 feet in length which encloses an elongated drive shaft 20, in this case a flexible drive shaft that is coupled through bevel gears 22 and 24 which are enclosed in a gear case 25, to an input shaft 26 of a speed reducer 28 that has a countershaft 30 driving an output shaft 33 which is rigidly connected to a rotating hub 34 upon which four horizontally disposed concrete finishing blades 36 are mounted so as to rotate during operation about a vertical axis for finishing a concrete or cement floor. The combined speed reduction of the bevel gears and gear box 28 can be about 30 to 1 so that the blades 36 typically rotate at about 60–130 rpm or 116 rpm at an engine speed of 3500 rpm. Engine speed is preferably controlled throughout operation by a hand throttle 11.

Figure 9:
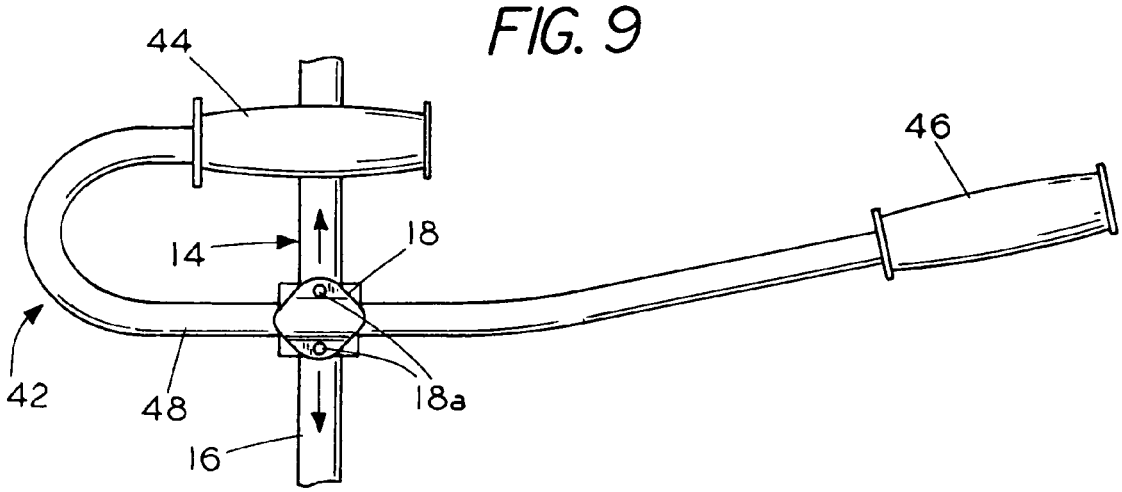
FIG. 9 is top view of the control handles used for maneuvering the invention shown on a larger scale than in FIG. 1.

The elongated connecting element or housing 16 can be used as a handle for manipulating the position of the operating head 10 as well as for lifting the operating head 10 over obstructions such as pipes 3*a* or a doorsill 38 resting on the floor 40. Housing 16 is set at an angle of 30° to the floor 40 (FIG. 1). Lifting of the operating head 10 and placing it to a new position can be accomplished easily with the present invention because the entire apparatus can be lifted from a point near the center of the connecting element 14 since the drive motor 12 partially counterbalances the weight of the operating head 10. In addition, precise positioning of the operating head during use can be easily achieved by means of a control handle or bar 42 (FIG. 9) which includes a pair of laterally spaced apart hand grips 44 and 46 that are secured to the ends of the handlebar 48 which is itself coupled to the tubular housing 16 by a releasable clamp 18 that allows the handle 42 to be moved up or down the tube 16 and locked in a selected position by tightening bolts 18*a*. The handgrip 44 can be positioned about 6" to 10" above the housing 16 and the grip 46 about 18" to 25" to one side. During operation, forward and rearward movement of the operating head 10 can be controlled by rotating the handle 42 about the axis of the housing 16 as shown by the arrow 50 while side-to-side motion of the operating head can be controlled by manually elevating or lowering of the housing 16 and motor 12. When the machine is not in use, the motor 12 and framework 14 can be supported on a stand 54. The stand 54 can be held in a raised position by means of a releasable hook 56.

The operating head 10 will now be described more fully by reference to FIG. 2.

Figure 11:
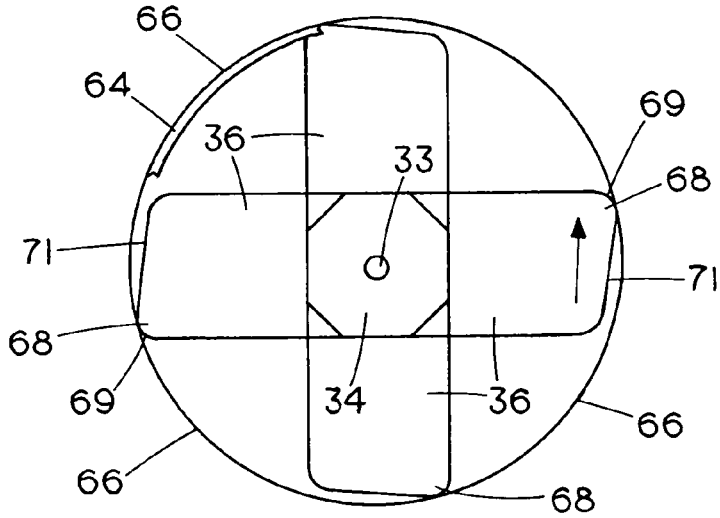
FIG. 11 is a diagrammatic plan view of the concrete finishing blades and guard ring of the invention on a larger scale than in FIG. 1.

Bolted to the gear case 28 is a safety shroud comprising radially extending diagonal bars 60 which are connected as by welding to circular ring elements 62 and 64 to enclose the blades 36 for safety purposes as they rotate. In addition, the ring 64 serves as a wall stop or guard ring. Its outer edge 66, e.g., 16" in diameter, is placed in direct alignment over the tip 68 of each of the blades 36 (FIGS. 1, 2 and 11). This enables the troweling blades 36 to finish a cement floor surface all the way to the wall or to a baseboard that is applied to the wall, i.e., to the edge of the floor leaving virtually no unfinished area that requires hand finishing. The invention, thus, is capable of finishing a larger area and eliminates hand finishing previously required around the edges of a room. The guard ring 64 is typically 16" in diameter.

Figure 2:
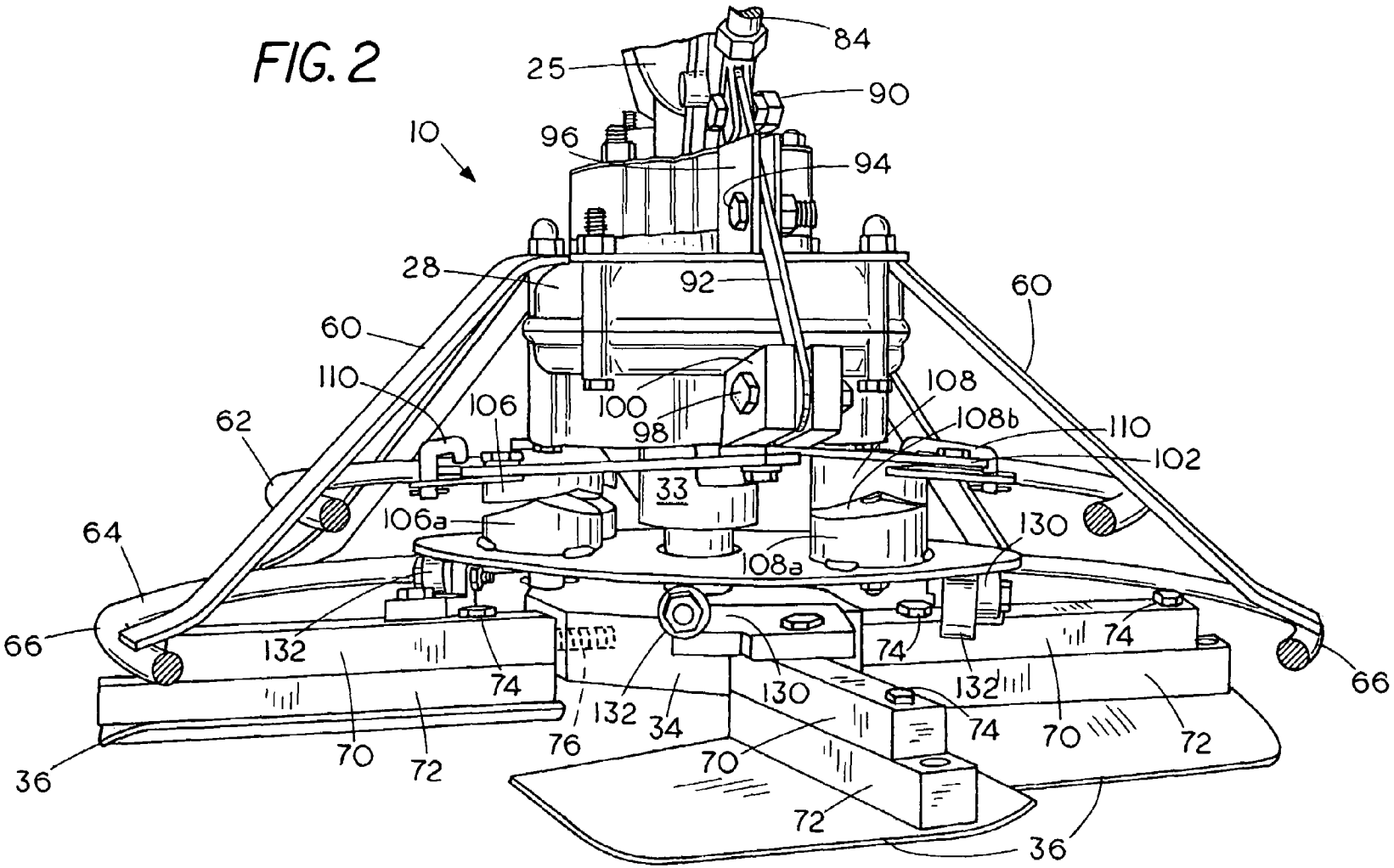
FIG. 2 is a rear end perspective view of the operating head of the invention partly broken away on a larger scale than in FIG. 1.
Figure 3:
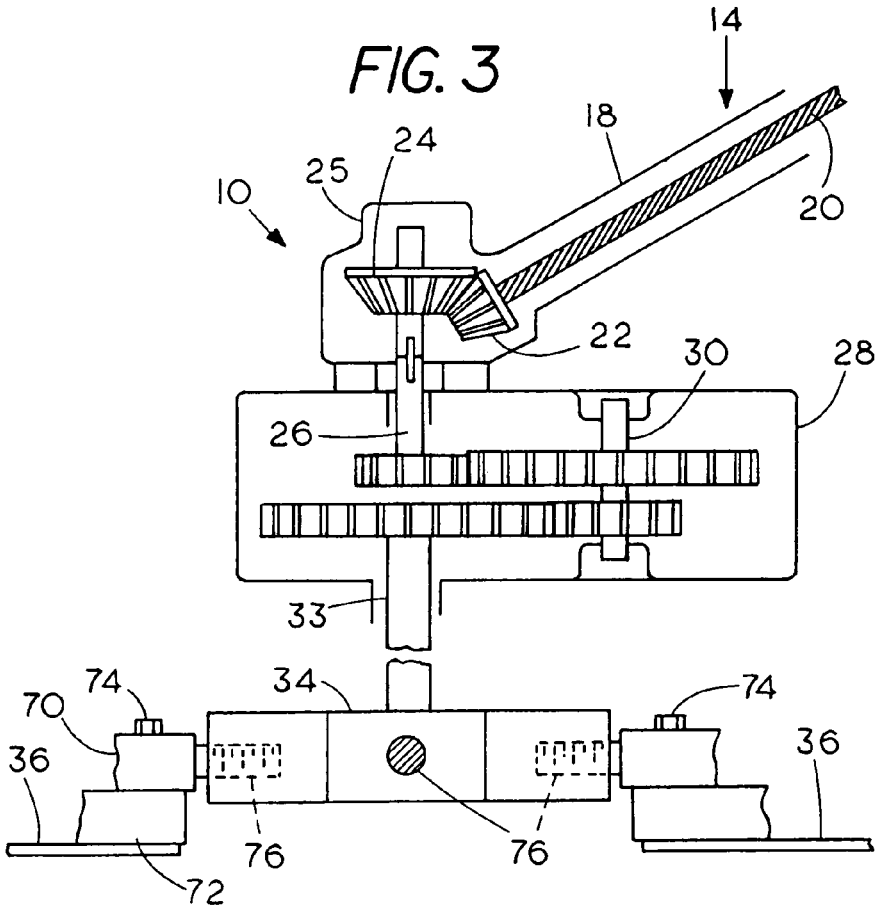
FIG. 3 is a diagrammatic vertical sectional view showing the transmission of power to the finishing blades.
Figure 4:
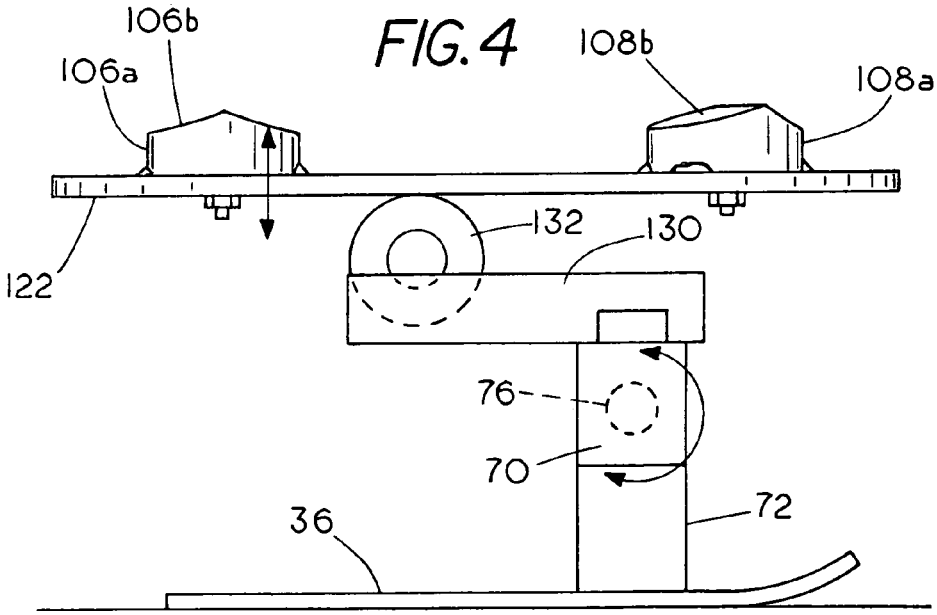
FIG. 4 is a diagrammatic side elevational view to show the pivotal mounting of the finishing blades.
Figure 5:
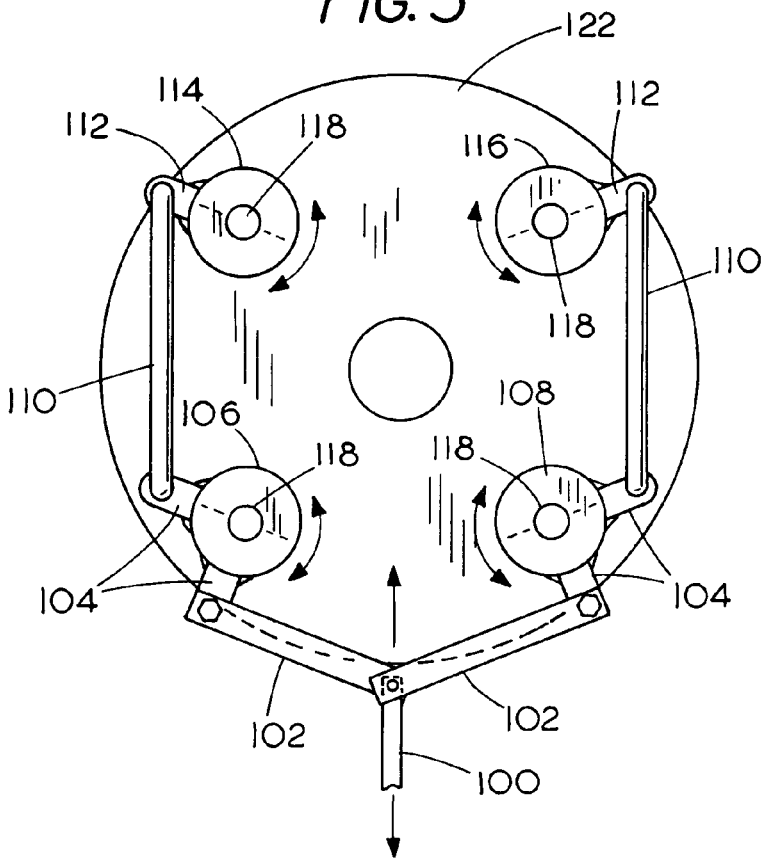
FIG. 5 is diagrammatic horizontal sectional view showing the blade pitch control mechanism.

In FIGS. 2 and 3 it can be seen that each of the blades 36 is supported on a pair of radially disposed arms 70 and 72 that are connected together, e.g., by bolts 74. Each of the upper arms 70 is mounted for rotation about a radial axis by the provision of a centrally extending threaded rod 76 connected to its inner end which is screw threaded into, but free to turn in the hub 34.

Figure 6:
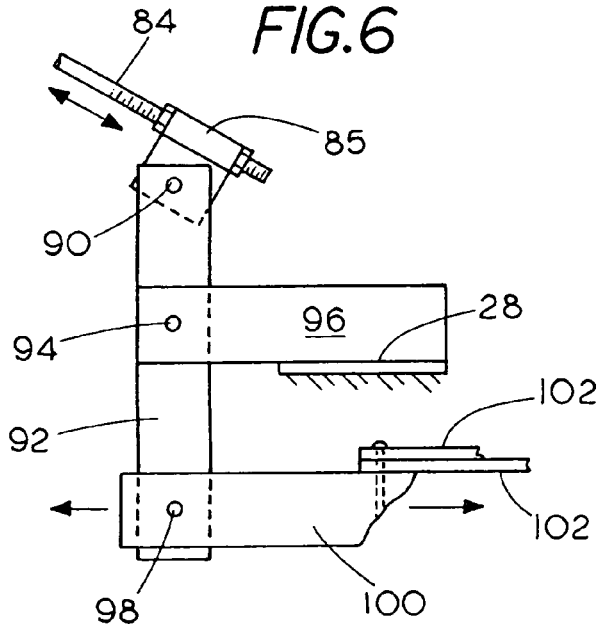
FIG. 6 is a partial side elevational view of blade pitch control links taken on line 6—6 on FIG. 1.
Figure 8:
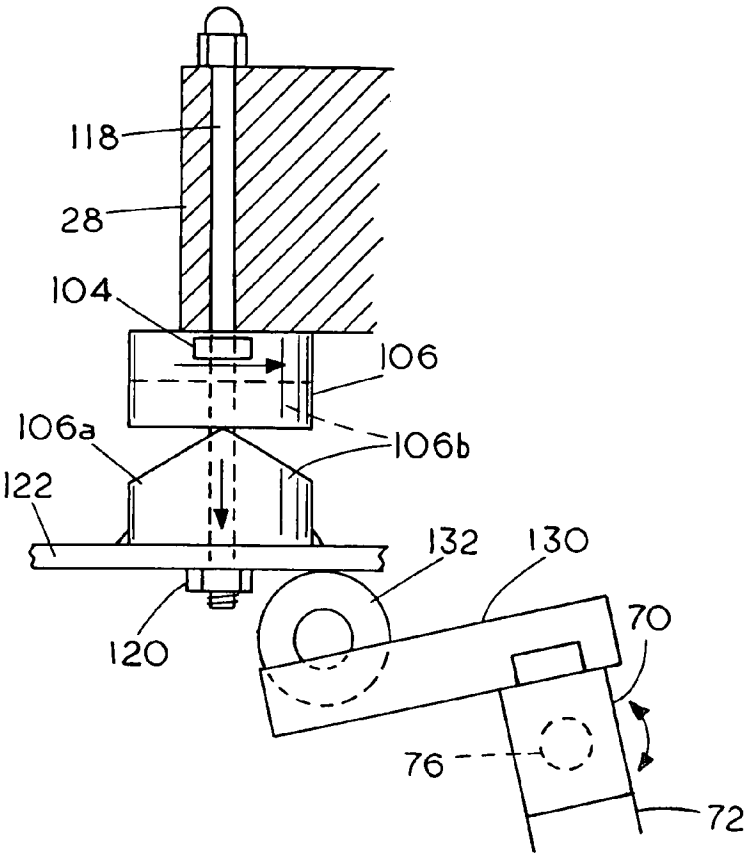
FIG. 8 is a view similar to FIG. 7 with a pitch change cam in its lowered position.
Figure 7:
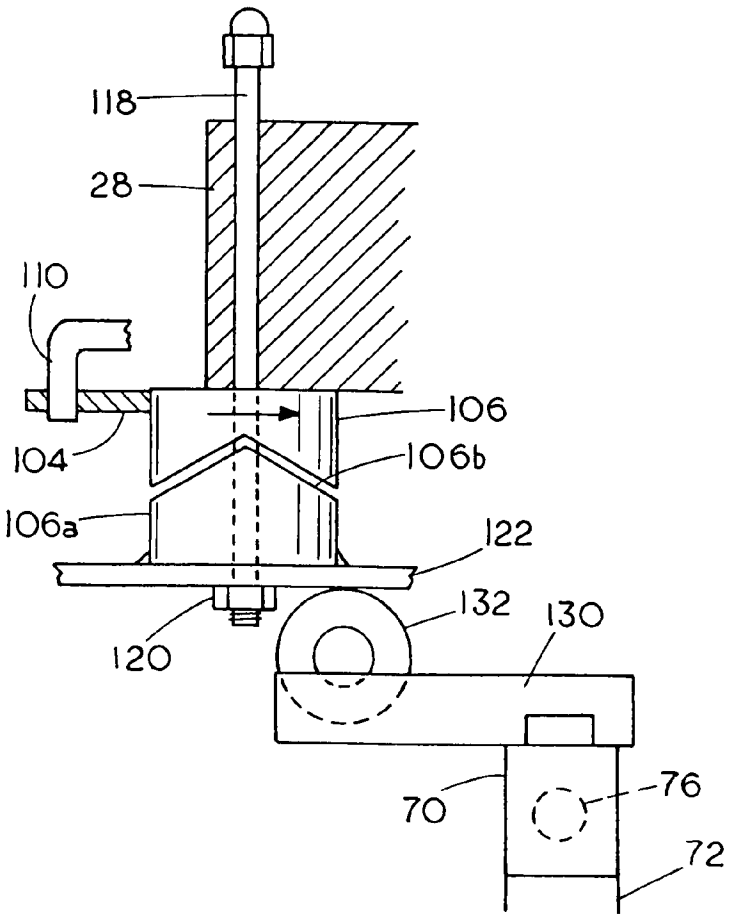
FIG. 7 is a diagrammatic view to show the operation of the blade pitch changing cams with a cam shown in its elevated position.
Figure 10:
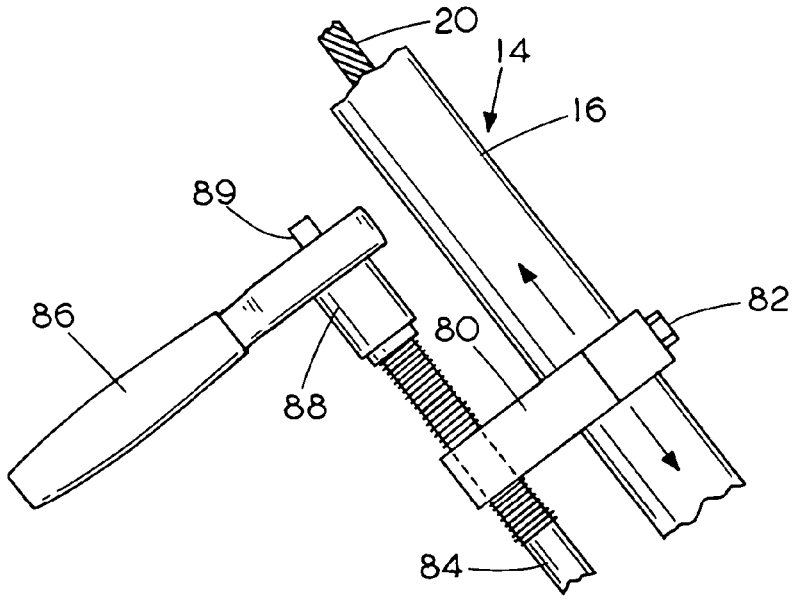
FIG. 10 is a partial side elevational view taken on line 10—10 of FIG. 1 on a larger scale than in FIG. 1.

The mechanism for changing the angular position or pitch of the blades 36 will now be described with reference to FIGS. 1, 2, 5–8 and 10. As shown in FIGS. 1 and 10, a support bracket 80 is clamped to the housing 16 by means of bolts 82 and can be moved up or down the housing 16 then by tightening bolts 82, locked in the desired position. Screw threaded through the bracket 80 is a positioning rod 84 having a positioning handle 86 at its upper end that is coupled to it by means of a reversible ratchet 88 similar to that on a reversible socket wrench for rotating the shaft 84 in either direction by turning a control lever 89. Thus, lever 89 controls the direction of rotation of the rod 84 when the handle 86 is moved. The movement of the control rod 84 acts through a leveling bracket 85 connected by pivot 90 to swing a link 92 about a pivot 94 which is connected rigidly to the gear housing 28 by a link 96. The leveling bracket 85 is bored to swivel freely on rod 84 and is held in place by a nut at each end (FIG. 6). The lower end of link 92 is in turn connected at 98 via a link 100 to two links or scissor arms 102 which are connected to arms 104 (FIG. 5) that are welded to rotary lifting cams 106 and 108 and in turn connected via links 110 to radial arms 112 which are welded to rotary lifting cams 114 and 116. The cams 106, 108, 114 and 116 are mounted for rotation on bolts 118 that are slideably mounted in the gear housing 28 and each is secured at its lower end by nut 120 to a circular positioning plate 122. Welded to the positioning plate 122 on the bolts 118 in alignment below the cams 106, 108, 114 and 116 are four similar cooperating cam members, only two of which, 106*a* and 108*a*, are shown in FIG. 2. In changing the blade pitch during operation, when the handle 86 is moved by the operator so as to screw the positioning rod 84 up or down in the bracket 80, the resulting pivotal movement of the link 92 will move the links 100, 102 and 110 in a given direction thereby rotating all of the upper cams 106, 108, 114 and 116 so that the rotating cams, acting through a sliding contact between mating cam surfaces, e.g., oblique surfaces 106*b* and 108*b* of the upper and lower four cams (FIGS. 7 and 8) lower the pitch control plate 122 as shown in FIG. 8 thereby lowering the free end of each of four control arms 130 through its contact with rollers 132 that are mounted on the free ends of arms 130 so as to tilt the blades 36 counter-clockwise thereby setting them at the desired pitch angle to achieve the proper finish for the cement or concrete floor that is being surfaced. The pitch of the mating cam surfaces is 30° to the horizontal.

Refer now to FIG. 11. While the precise shape of the outer edge of each blade 36 can be varied, excellent results have been achieved by rounding each leading edge at 69 and providing a taper that extends centrally at a small angle, as shown, proceeding at 71 toward the trailing edge of each blade. The tip 68 of each blade as already mentioned is aligned directly beneath the outer edge 66 of the guard ring 64.

Figure 12:
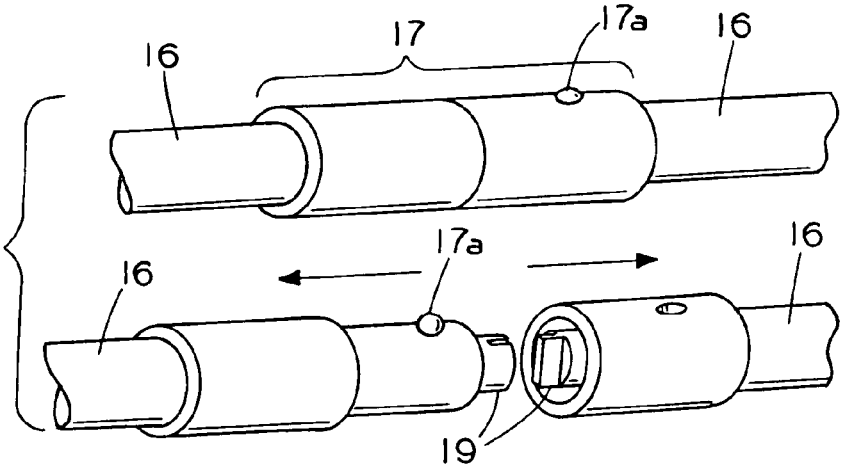
FIG. 12 is a perspective view of an optional separable drive shaft coupling that can be coupled for lengthening the handle or separated for removing the engine and FIG. 13 is a perspective view of an optional finishing pan that can be attached to the blades when desired.

Optionally, as shown in FIG. 12, the shaft housing 16 can be provided if desired with a separable coupling 17 that is secured together when coupled by a detent 17*a* to allow the invention to be collapsed for storage or transport. The drive shaft 20 in that case is suitably connected, e.g., by means of a tongue and groove connection 19 which fits together when the coupling is assembled.

Figure 13:
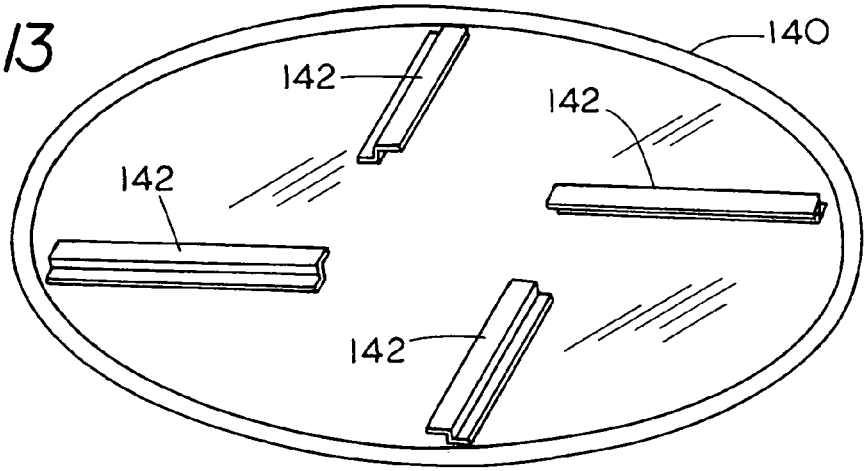

FIG. 13 shows an optional flat circular finishing disk 140 that can be connected to the blades 36 if desired by means of radially extending retainers 142 which are welded to the upper surface of the finishing disk 140 so that the leading edge of each blade 36 can be slid beneath the leading edge of one of the retainers. The retainers will hold disk 140 in place as the blades rotate during operation.

The invention is a relatively inexpensive and light in weight concrete finisher, typically weighing about 40 pounds that is characterized by having a balanced structure so that by grasping the shaft housing 16 near its center one can lift the entire device since the motor 12 will at least partially counterbalance the weight of the operating head 10. The operating head 10 typically weighs about 31 pounds while the motor 12 and shaft 16 typically weigh about 9 pounds. A heavier motor will provide even better balance. In addition, the much lower profile of the operating head 10 enables it to move under obstructions such as a staircase or other object that is part of the building. Moving the handle 42 enables the operating head to be maneuvered forward or back or left to right as the blades rotate to achieve precise positioning control throughout operation. Moreover, the alignment of the blades 36 directly below the outer edge 66 of the guard ring 64 makes it possible for floors to be finished all the way to the wall so that no manual finishing on hands and knees is required. To change the pitch of the blades 36, the handle 86 can be moved manually so as to shift the control rod either up or down for changing the position of the rotary cams 106, 108, 114 and 116 thereby moving the finishing blades to the desired pitch angle.

Many variations of the present invention within the scope of the appended claims will be apparent to those skilled in the art once the principles described herein are understood.

What is claimed is:

1. A rotary concrete finishing trowel apparatus comprising, an operating head at one end of the apparatus having a blade shaft rotatably mounted thereon with at least one finishing blade connected thereto for rotation in a horizontal plane to finish a concrete floor surface, an operator supported drive motor at the other end of said apparatus that is spaced laterally from the operating head such that the motor does not rest upon the operating head, an elongated frame element connected at one end to the drive motor and at the other end to the operating head said frame element providing a lifting point for the operator such that during operation the weight of the motor is able to at least partially counterbalance the weight of the operating head including the rotating finishing blade, and a drive shaft extending between the motor and the operating head for imparting rotation to the shaft to rotate the finishing blade for smoothing the surface of a cement or concrete floor.

2. The apparatus of claim 1 wherein the elongated frame element is connected at one end to the drive motor and is connected at the other end to the operating head so that a lateral movement of said finishing blade on the floor can be controlled during operation by an operator raising or lowering the motor.

3. The apparatus of claim 1 wherein the operating head includes a shroud having a fixed guard ring positioned in vertical alignment above a tip of finishing blade to enable the floor to be finished substantially to a wall at the edge of the floor.

4. The apparatus of claim 1 wherein the elongated frame element comprises a tubular housing, the drive shaft extends through said tubular housing, an upper end of the tubular housing is connected to a framework of the motor and a lower end of the housing is connected to the operating head.

5. The apparatus of claim 1 wherein the blade is mounted for pivotal movement about a horizontal radially extending axis and at least one member is operatively connected thereto for tilting the finishing blade about said horizontal radial axis.

6. The apparatus of claim 4 wherein the tubular housing is of sufficient length to place the motor to the rear of an operator when the apparatus is grasped near its center such that the weight of the motor aids in balancing the operating head when lifted over obstructions.

7. The apparatus of claim 6 wherein the tubular housing is about 4 or 5 feet in length.

8. The apparatus of claim 4 wherein the tubular housing extends laterally from the operating head on a slope that is inclined upwardly proceeding toward the drive motor when the apparatus is resting on a floor during use.

9. The apparatus of claim 8 wherein the operating head has a gearbox and the tubular housing for the drive shaft is connected to the gearbox so as to define said slope of the tubular housing.

10. The apparatus of claim 1 wherein the blade has an outer edge with a taper that extends centrally proceeding toward a trailing edge of the blade.

11. The apparatus of claim 10 wherein the blade has a leading edge that is rounded adjacent an outer tip of the blade.

12. A rotary concrete finishing trowel comprising, an operating head at one end of the apparatus having a blade shaft rotatable mounted thereon with at least one finishing blade connected thereto for rotation in a horizontal plane to finish a concrete floor surface, a drive motor at the other end of said apparatus, an elongated frame element connected at one end to the drive motor and at the other end to the operating head and a drive shaft extending between the motor and the operating head for imparting rotation to the shaft to rotate the finishing blade for smoothing the surface of a cement or concrete floor and the operating head includes a plurality of spaced apart cam members, a linkage assembly is connected to said cam members and a blade positioning plate is operatively associated with the cam members for movement upon the operating head to pivot each finishing blade about a horizontal radial axis.

13. A concrete floor finishing trowel apparatus with an operator supported motor comprising, an operating head having a transmission at an upper end thereof and a plurality of floor finishing trowel blades that extend radially from a vertical output shaft that is connected to the transmission for rotation thereon at a lower end thereof for finishing a concrete floor surface and for supporting the operating head without supporting the motor as the trowel blades are rotated thereby upon the floor surface, an elongated frame element connected at a first end to the operating head and extending laterally therefrom, an operator supported drive motor spaced laterally apart from the operating head and connected to an end of the frame element opposite said first end such that the weight of the drive motor is not applied to the rotating trowel blades during operation, a handle on the apparatus for enabling an operator to support the motor a drive shaft operatively connected between the drive motor and the transmission for imparting rotation to the finishing trowel blades for smoothing the concrete floor surface.

14. The apparatus of claim 13 wherein the frame element comprises a tubular shaft housing, the drive shaft extends through the tubular housing and is operatively connected at a lower end thereof to the transmission for rotating the floor finishing blades.

15. The apparatus of claim 13 wherein the operating head includes a guard ring positioned in vertical alignment above a tip of each finishing blade for enabling the floor to be finished all the way to a wall at an edge thereof.

16. The apparatus of claim 13 wherein the elongated frame element comprises a tubular housing, the drive shaft extends through said tubular housing, an upper end of the tubular housing is connected to a framework of the motor, a lower end of the tubular housing is connected to a housing of the transmission such that rotation of the drive shaft rotates the floor finishing blades.

17. The apparatus of claim 13 wherein each blade is mounted for pivotal movement on horizontal radially extending axis and a position control member is operatively connected thereto for changing the pitch of each finishing blade on said horizontal radial axis.

18. The apparatus of claim 13 wherein the motor is spaced apart from the operating head for at least partially counter-balancing the weight of the operating head during operation to thereby facilitate raising the operating head over objects by said operator lifting the handle and positioning the operating head in confined spaces.

* * * * *